United States Patent [19]

Harding

[11] Patent Number: 4,793,500

[45] Date of Patent: Dec. 27, 1988

[54] TAMPER INDICATOR

[76] Inventor: Claude J. Harding, 3520 E. Cannon Dr., Phoenix, Ariz. 85028

[21] Appl. No.: 119,389

[22] Filed: Nov. 10, 1987

[51] Int. Cl.[4] ..... B65D 55/02

[52] U.S. Cl. ..... 215/230; 116/307

[58] Field of Search ..... 215/230, 365; 116/279, 116/307

[56] References Cited

U.S. PATENT DOCUMENTS

| | | | |
|---|---|---|---|
| 4,424,911 | 1/1984 | Resnick | 215/365 |
| 4,436,213 | 3/1984 | Paul, Jr. et al. | 215/365 |
| 4,446,979 | 5/1984 | Gach et al. | 215/203 |
| 4,448,317 | 5/1984 | Thompson | 215/203 |
| 4,475,661 | 10/1984 | Griffin | 215/366 |
| 4,500,005 | 2/1985 | Forrester | 215/203 |
| 4,502,605 | 3/1985 | Wloszczyna | 215/230 |
| 4,505,399 | 3/1985 | Weiner | 215/230 |
| 4,519,515 | 5/1985 | Schonberger | 215/230 |
| 4,526,752 | 7/1985 | Perlman et al. | 422/56 |
| 4,588,098 | 3/1986 | Uzdy | 215/230 |
| 4,591,062 | 5/1986 | Sandhaus | 215/230 |

*Primary Examiner*—Donald F. Norton

*Attorney, Agent, or Firm*—Cahill, Sutton & Thomas

[57] ABSTRACT

A tamper indicator includes a first indicator element coupled to a first cylindrical element, a second indicator element positioned within a second cylindrical element and displaceable between a first position spaced apart from the first indicator element and a second position contacting the first indicator element. The first indicator element changes visual states when it contacts the second indicator element. A biasing device biases the first indicator element toward the second indicator element. A locking system maintains the first and second indicator elements in a locked, spaced apart configuration while the first and second cylindrical elements remain in a first location. The locking device enables relative movement to occur between the first and second indicator elements after the first and second cylindrical elements have been displaced from the first position into a second position. The locking device enables the biasing device to displace the first and second indicator elements together to establish contact and to effect the change in visual state of the first indicator element upon displacement of the first and second cylindrical elements from the second position into a third position.

19 Claims, 3 Drawing Sheets

TAMPER INDICATOR

SUMMARY OF THE INVENTION

It is therefore a primary object of the invention to provide a tamper indicator which is configured into a locked state upon completion of manufacture, into an armed state upon installation at a site where the tamper indicator is intended to be used, and into an actuated state when appropriate relative movement is imparted to the device.

Another object of the present invention is to provide a tamper indicator which can be attached to the cap of a medication dispenser without modifying either the cap or the medication container.

Another object of the present invention is to provide a tamper indicator which produces an irreversible indication of tampering.

Another object of the present invention is to provide a tamper indicator which is inexpensive to fabricate, small in physical size, and entirely incorporated within a single integrated unit.

Briefly stated, and in accord with one embodiment of the invention, a tamper indicator includes a first cylindrical element having a first interior chamber and a second cylindrical element having a second interior chamber. The first and second cylindrical elements are telescopically interconnected and displaceable between first, second and third positions. A displacement between the first and second positions moves the first and second cylindrical elements closer together while a displacement between the second and third positions moves the first and second cylindrical elements further apart. Indicator means includes a first indicator element which is coupled to the first cylindrical element and positioned within the first interior chamber and a second indicator element which is positioned within the second interior chamber and displaceable between a first position spaced apart from the first indicator element and a second position contacting the first indicator element. The first indicator element changes visual state when it contacts the second indicator element. Biasing means biases the first indicator element toward the second indicator element. A locking device maintains the first and second indicator elements in a locked, spaced apart configuration while the first and second cylindrical elements remain in the first position. The locking device also enables relative movement to occur between the first and second indicator elements after the first and second cylindrical elements have been displaced from the first position into the second position. The locking device further enables the biasing means to displace the first and second indicator elements together to establish contact and to effect the change in visual state of the first indicator element upon displacement of the first and second cylindrical elements from the second position into the third position.

BACKGROUND OF THE INVENTION

1. Field of the Invention

This invention relates to tamper indicators, and more particularly, to tamper indicators which function in response to relative movement between two separate elements of the indicator.

2. Description of the Prior Art

A wide variety of tamper indicators have been developed in the past primarily for application to medication containers including a cap and either a bottle or plastic container of a variety of configurations.

U.S. Pat. No. 4,424,911 (Resnick) discloses a tamper indicator for medicine bottles which changes color upon the application of pressure to the bottle during opening. A pliable strip is affixed to the exterior of the medication container. The strip contains fragile microspheres which, upon application of pressure caused by opening the container, changes the color of the strip.

U.S. Pat. No. 4,446,979 (Gach et al.) discloses a tamper indicating container having a two section cap. Relative rotation of the two cap sections during container opening displaces an "opened" sign into view on the top of the cap.

U.S. Pat. No. 4,448,317 (Thompson) discloses a tamper indicator for a container which includes a color change mechanism implemented by stress whitening or by an encapsulated coloring agent incorporated into a matrix. The color change is produced as a result of cap rotation.

U.S. Pat. No. 4,475,661 (Griffin) discloses a tamper indicating container having a transparent window in the cap. The indicator assembly includes a defaceable visual pattern such that movement of the cap relative to the receptacle defaces a visual pattern which becomes viewable through the cap.

U.S. Pat. No. 4,500,005 (Forrester) discloses a tamper-evident cap assembly for a container which includes a two-section rotatable bottle cap. Initial opening of the cap rotates one cap section with respect to the second cap section and moves the word "open" into view through an aperture in the top of the cap.

U.S. Pat. No. 4,502,605 (Wloszczyna) discloses a container closure identity system including two cap sections rotatable with respect to each other. One cap section contains dye while the other cap section contains an absorbent sheet together with an actuator. A transparent window in the cap permits the user to observe the color change caused by relative rotation of the two cap sections during opening of the container.

U.S. Pat. No. 4,436,213 (Paul, Jr. et al.) discloses a container having a tamper-evident seal. This device includes a transparent polymer film capable of being rendered transparent by the application of pressure to the film. A safety symbol is visible only if the container has not been previously opened.

U.S. Pat. No. 4,505,399 (Weiner) discloses a tamper-indicating device utilizing a light or oxygen responsive sheet which changes appearance irreversibly upon exposure to either light or oxygen.

U.S. Pat. No. 4,519,515 (Schonberger) discloses a tamper-evident lid for a container including a disc which is seated at the top of a bottle neck. The disc is coated with dye-filled micro capsules. The lower surface of the lid includes an abrasive material which ruptures the micro capsules when the lid is rotated to open the container.

U.S. Pat. No. 4,526,752 (Perlman et al.) discloses an oxygen indicator for packaging where the indicator changes condition upon exposure to oxygen.

U.S. Pat. No. 4,588,098 (Uzdy) discloses an enclosure having tamper indicating means including an indicator marker/pointer which moves in response to opening of the bottle and cannot be returned. This device includes a two-section cap having an upper part which rotates with respect to a lower part upon initial bottle opening.

U.S. Pat. No. 4,591,062 (Sandhaus) discloses a tamper-evident closure apparatus which includes a closure with a mechanism for venting internal pressurized gas upon unsealing of the container. In response to discharge of pressurized gas through a vent, indicator means changes color or is changed in physical shape to indicate tampering.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

DESCRIPTION OF THE PREFERRED EMBODIMENT

Figure 1:
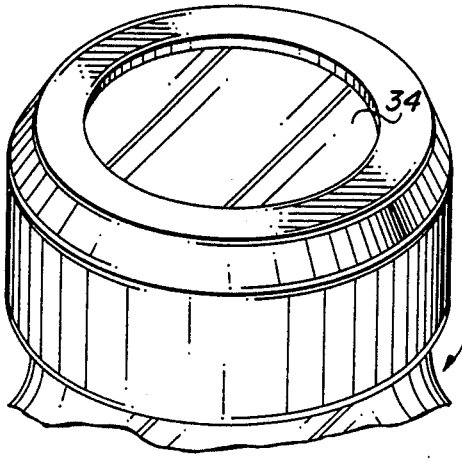
FIG. 1 is a partially cut away perspective view showing the tamper indicator of the present invention embodied in a medication bottle cap and depicting the indicator means prior to change of visual state.

In order to better illustrate the advantages of the invention and its contributions to the art, a preferred hardware embodiment of the invention will now be described in some detail.

Referring now to FIGS. 1, 3, 6 and 7, a preferred embodiment of the tamper indicator of the present invention is shown as being fabricated as a part of a cap 10 of a medication container 12. The tamper indicator includes a first cylindrical element 14 and a second cylindrical element 16 which is telescopically interconnected with first cylindrical element 14 and displaceable between first, second and third positions relative to first cylindrical element 14. First cylindrical element 14 includes a first interior chamber 18 while second cylindrical element 16 includes a second interior chamber 20.

The tamper indicator of the present invention includes indicator means for enabling a consumer to visually determine whether cap 10 has been removed from the mouth of medication container 12 after original assembly and closure of the medication product at the factory. The indicator means includes a first indicator element 22 which is coupled to the first cylindrical element 14 and is positioned within the first interior chamber 18. The indicator means further includes a second indicator element 24 which is positioned within second interior chamber 20 and is displaceable between a first or "safe" position depicted in FIG. 3 where the second indicator element 24 is spaced apart from the first indicator element 22 and a second or "unsafe" position depicted in FIG. 5 where the second indicator element 24 contacts the first indicator element 22 and changes visual state as a result of contact with second indicator element 24.

Figure 6:
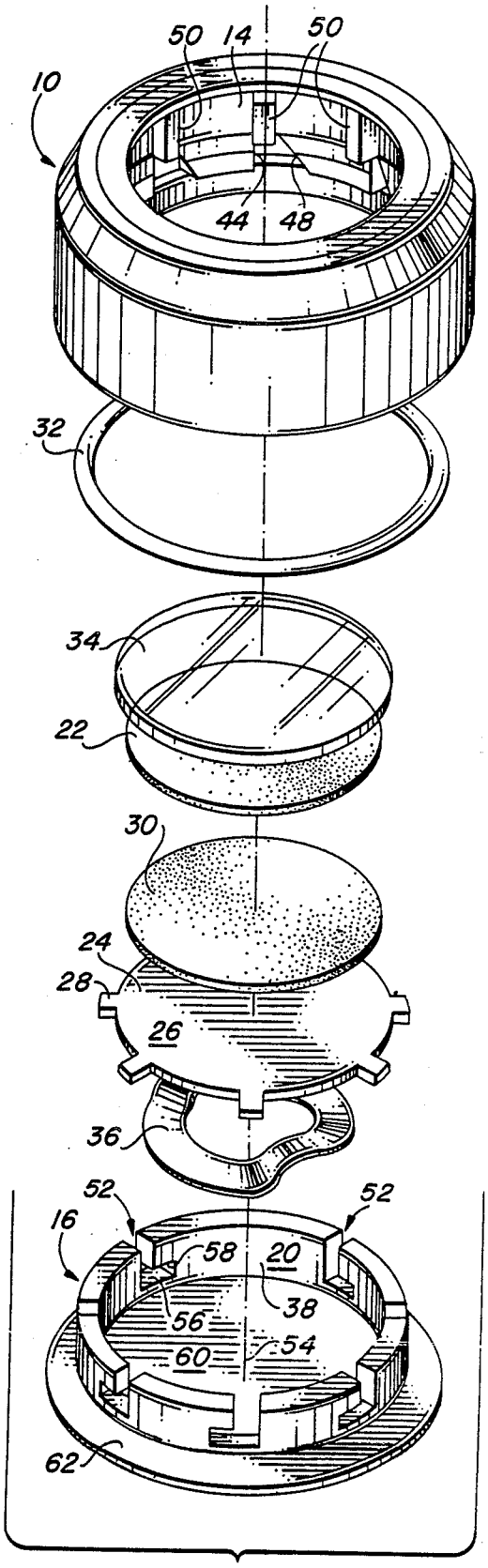
FIG. 6 is a perspective view depicting the various elements of the invention in an exploded configuration.

Second indicator element 24 may be configured as a two part assembly as depicted in FIG. 6 where it includes a thin cylindrical disc 26 including a plurality of circumferentially spaced apart spokes 28 in combination with a separate color change element 30. In the preferred embodiment of the invention depicted in FIG. 6, the color change element 30 takes the form of a reservoir for colored liquid such as red ink. Reservoir 30 may take the form of a sponge, ink reservoir or equivalent device for retaining a colored liquid such as ink and for maintaining such colored liquid in a non-evaporated form for a long period of time. An O-ring seal 32 hermetically seals together the various elements of the tamper indicator to prevent evaporation and loss of the colored liquid from color change element 30.

The first indicator element 22 takes the form of means for receiving colored liquid and may include an absorbent material such as a blotter or equivalent device. The upper surface of the first indicator element 22 is coupled to the lower surface of viewing means which takes the form of a transparent cylindrical window 34 which is fitted into a cylindrical aperture in the upper surface of cap 10. In one embodiment of the invention, color change element 30 includes a predetermined quantity of red ink while the first indicator element 22 takes the form of a white paper blotter.

Biasing means in the form of a piece of spring steel 36 is positioned within the cylindrical chamber defined by the base of second cylindrical element 16, the lower surface of disc 26 and the vertically oriented, cylindrical walls 38 of second cylindrical element 16. Biasing means 36 may take the form of the spring steel element depicted in the drawings or many alternative embodiments including a coil spring as would be readily apparent to one of ordinary skill in the art. Biasing means 36 exerts a constant upward biasing force which biases the first and second indicator elements 22 and 24 together.

Figure 7:
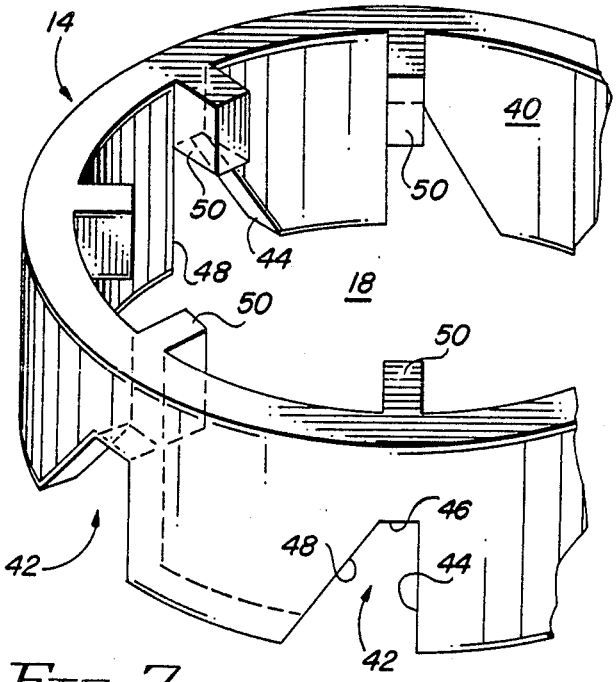
FIG. 7 is a partially cut away perspective view of the first cylindrical element of the invention.

The first cylindrical element 14 includes a vertically oriented wall 40. Wall 40 includes a plurality of circumferentially spaced apart, specially configured cutouts 42 which serve to laterally displace spokes 28 and to thereby rotate disc 26 in a manner explained below. Each cutout 42 includes a vertically oriented surface 44, a horizontally oriented upper surface 46 and an inclined, spoke engaging and displacing surface 48. The wall 40 of first cylindrical element 14 also includes alignment means in the form of a plurality of circumferentially spaced apart, inwardly extending lugs 50 which may be either aligned with the vertical and horizontal surfaces 44 and 46 of cutouts 42 as depicted in FIG. 7 or may be laterally offset from cutouts 42.

Referring now to FIG. 6, second cylindrical element 16 includes a plurality of circumferentially spaced apart, vertically oriented slots 52 which are oriented parallel to the longitudinal axis 54 of the tamper indicator. Slots 52 include a base 56 and a laterally extending notch 58.

The second cylindrical element 16 further includes a continuous base 60 which extends outward beyond vertically oriented wall 38 to form a flange 62.

Figure 3:
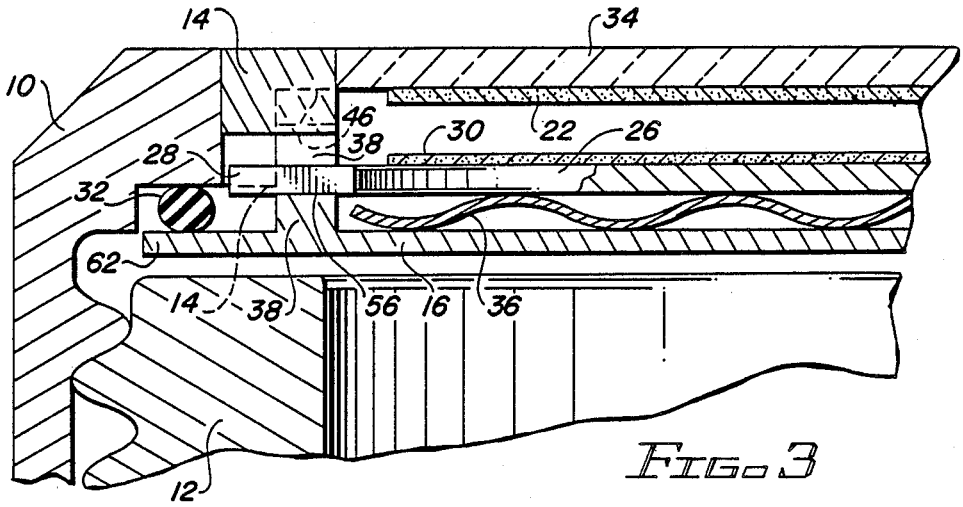
FIG. 3 depicts a partially cut away sectional view of the tamper indicator depicted in FIG. 1 illustrating the "locked" configuration.
Figure 8A:
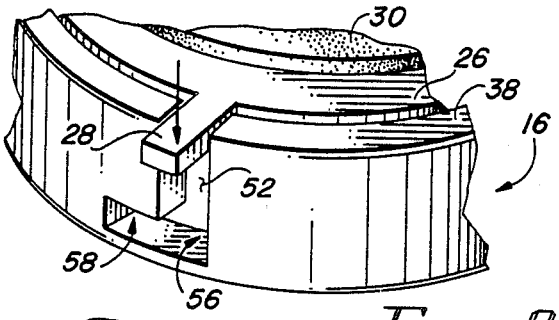
FIGS. 8A–8D show the sequential repositioning of various elements of the present invention between the first, second and third relative positions.

The operation of the invention will now be explained by referring to FIGS. 3, 4, 5 and 8. During the original manufacture of the tamper indicator, the spokes 28 of disc 26 are aligned with the circumferentially spaced apart slots 52 disposed in wall 38 of second cylindrical element 16. As shown in FIG. 8A, disc 28 is vertically displaced with respect to second cylindrical element 16 until each spoke 28 is aligned and level with the laterally extending notches 58 in wall 38. Disc 26 is then rotated in a clockwise direction when viewed from above to displace spokes 28 into the "locked" or first position depicted in FIG. 8B. FIG. 3 also depicts the various elements of the invention in the "locked" or first position before cap 10 is screwed down tightly onto the mouth of medication container 12.

Figure 4:
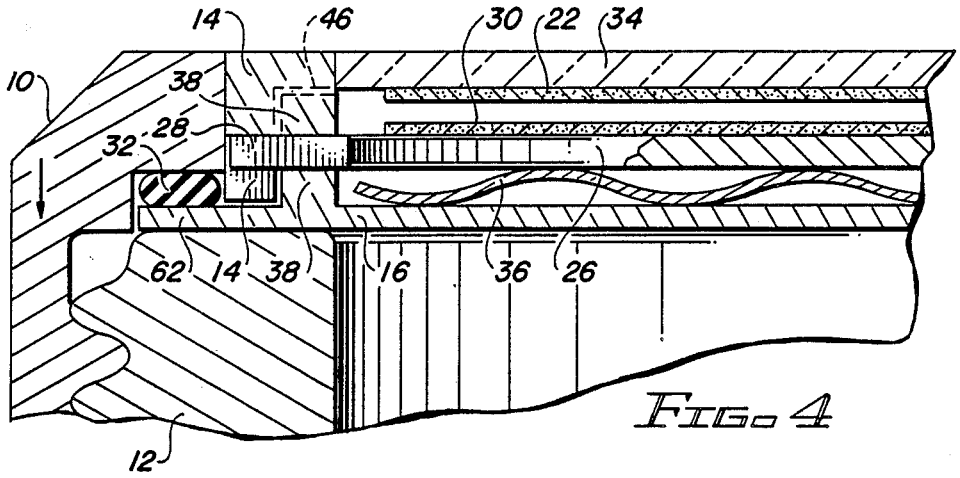
FIG. 4 is a partially cut away sectional view of the tamper indicator of the present invention illustrating the "armed" configuration.
Figure 8B:
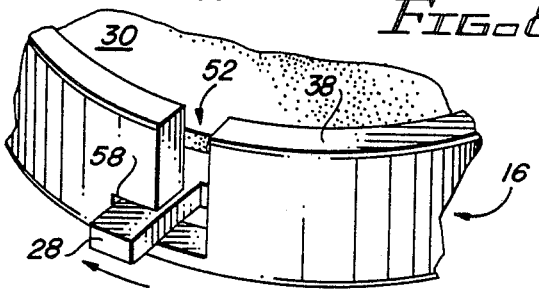
Figure 8C:
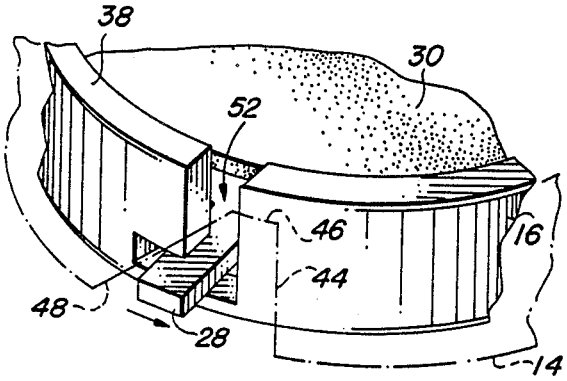

As depicted in FIGS. 4 and 8C, rotation of cap 10 displaces cap 10 downward with respect to the mouth of medication container 12 as illustrated by the compression of O-ring seal 32. The resulting downward displacement of first cylindrical element 14 with respect to the vertically fixed second cylindrical element 16 causes the inclined, spoke engaging surface 48 of first cylindrical element 14 to engage the protruding surface of spokes 28 and to rotate the spokes 28 as well as disc 26 counterclockwise with respect to the remaining, non-rotatable elements of the tamper indicator of the present invention. By the time cap 10 has been downwardly displaced into its fully closed, sealed position depicted in FIG. 4, the horizontally oriented upper surface 46 of cutouts 42 will be displaced into contact with the upper surface of each spoke 28 and each spoke 28 will be vertically aligned within each vertically oriented slot 52 of second cylindrical element 16. This second position of the tamper indicator as depicted in FIGS. 4 and 8B is referred to as the "armed" configuration.

Figure 2:
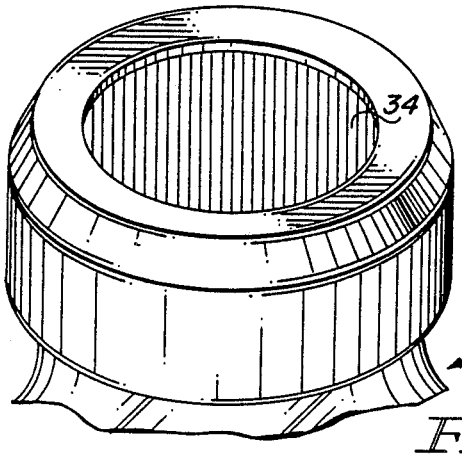
FIG. 2 is a partially cut away perspective view of a medication container cap incorporating the tamper detector of the present invention and depicting the indicator means in the actuated state after a change of visual state.
Figure 5:
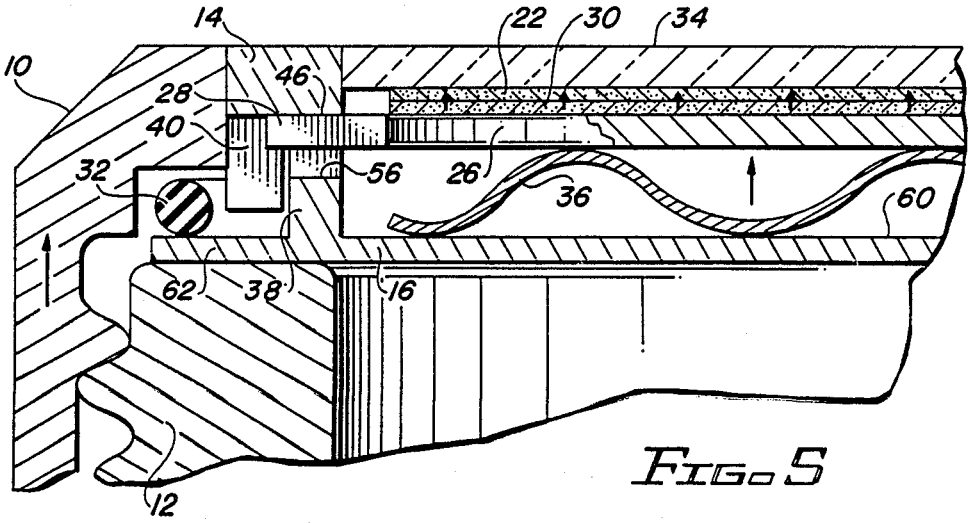
FIG. 5 is a partially cut away sectional view of the present invention showing the tamper indicator in the "actuated" configuration.
Figure 8D:
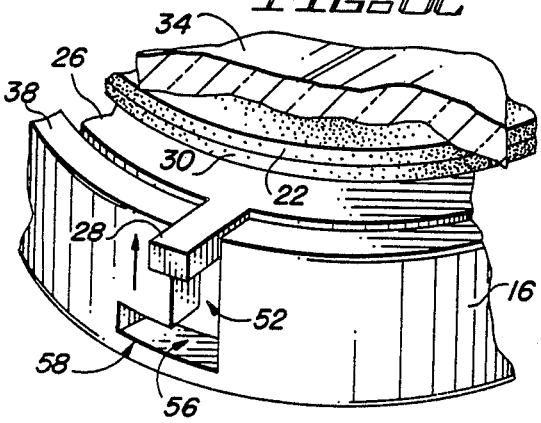
Figure 9:
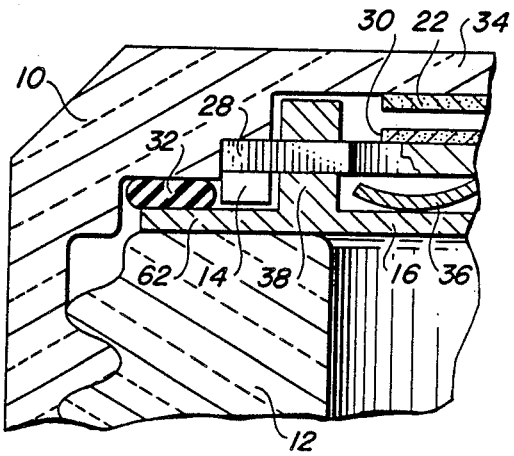
FIG. 9 is a partially cut away sectional view of the present invention showing the tamper indicator formed as an integral part of a medication container cap.

When the cap 10 of medication container 12 is unscrewed by either an unauthorized party or by a consumer, spring 36 causes upward relative displacement between the first cylindrical element 14 as cap 10 is unscrewed while the second cylindrical element 16 remains in contact with the mouth of container 12. This relative longitudinal movement between the first and second cylindrical elements 14 and 16 after slots 28 have been rotated into the "armed" position in alignment with slots 52 causes the second indicator element 30 to be longitudinally displaced and to contact and change the color of first indicator element 22. This color change of first indicator element 22 can be viewed by a consumer through transparent cylindrical insert 34. FIGS. 5 and 8D depict the tamper indicator of the present invention in this third position which is referred to as the "actuated" configuration. FIG. 2 depicts the "unsafe" container configuration after the color change of first indicator element 22 has taken place.

During manufacture, the installation of cap 10 on medication container 12 displaces the elements of the tamper indicator between the first and second positions. As a result of this configuration change, first cylindrical element 14 is longitudinally displaced toward second cylindrical element 16 while disc 26 and spokes 28 are rotationally displaced in a counterclockwise direction as a result of contact and movement between spokes 28 and the inclined, spoke-engaging surface 48 of cutouts 42. During the transition from the second position to the third position, second cylindrical element 16 is longitudinally displaced away from first cylindrical element 14 while spokes 28 are aligned with slots 52, enabling biasing menas 16 to displace color change element 30 into contact with first indicator element 22.

The plurality of circumferentially spaced apart lugs 50 disposed around the interior surface of wall 40 of first cylindrical element 14 interface with the upper parts of slots 52 in second cylindrical element 16 and prevent relative rotational displacements between first cylindrical element 14 and second cylindrical element 16 during transitions between the first and second positions as well as between the second and third positions. Lugs 50 and slots 52 therefore serve as alignment means for the tamper indicator.

Figure 10:
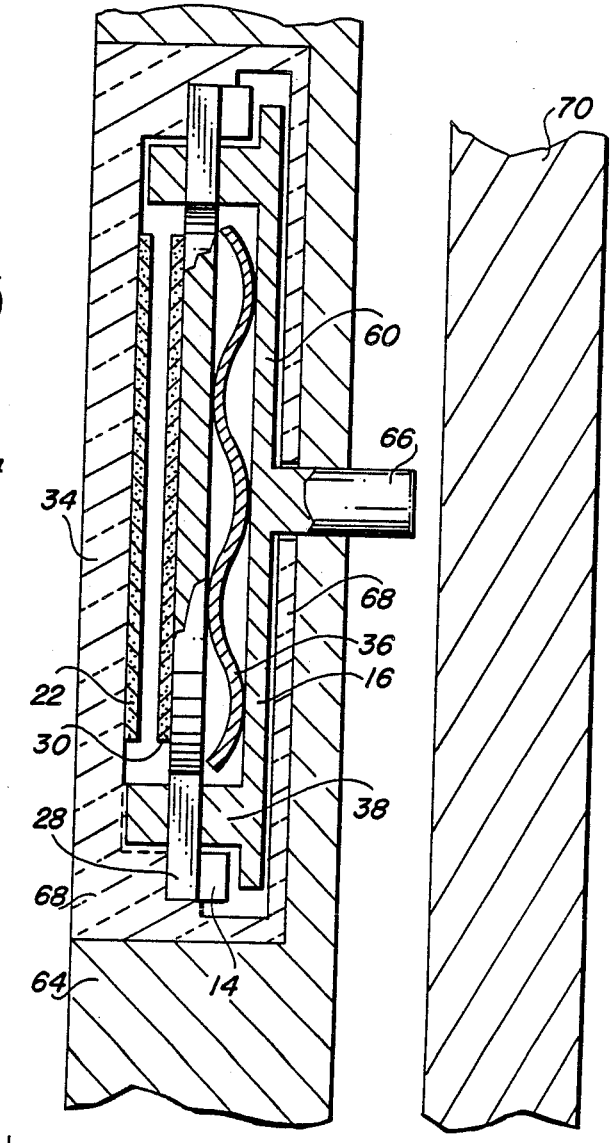
FIG. 10 is a sectional view of another embodiment of the present invention which is used as a tamper indicator for applications other than medication containers.

FIG. 10 depicts an operationally identical version of the tamper indicator of the present invention installed in the jamb 64 of a door frame. An actuator shaft 66 is coupled to and extends outward from the base 60 of second cylindrical element 16 as illustrated in FIG. 10. A housing 68 is non-displaceably coupled to first cylindrical element 14 and extends around and below the base 60 of second cylindrical element 16 as illustrated. The tamper indicator of FIG. 10 is illustrated in the first or "locked" configuration. Closure of a door 70 against jamb 64 will inwardly displace actuator 66 relative to the remaining elements of the tamper indicator, causing the tamper indicator to be displaced from the first or "locked" position into the second or "armed" position. When door 70 is opened with respect to door jamb 64, actuator 66 is outwardly displaced causing the tamper indicator to be displaced from the second or "armed" position into the third or "actuated" position resulting in a color change of the first indicator element 22 as viewed through transparent cylindrical insert 34.

Except for the differences noted above, the structure and operation of the FIG. 10 embodiment of the invention is identical to the structure of the tamper indicator described in connection with the remaining figures as illustrated in connection with the cap of a medication container.

It will be apparent to those skilled in the art that the disclosed tamper indicator may be modified in numerous ways and may assume many embodiments other than the preferred forms specifically set out and described above. Accordingly, it is intended by the appended claims to cover all such modifications of the invention which fall within the true spirit and scope of the invention.

I claim:

1. A tamper indicator comprising:

a. a first cylindrical element having a first interior chamber;

b. a second cylindrical element telescopically interconnected with said first cylindrical element, displaceable between first, second and third positions relative to said first cylindrical element and including a second interior chamber, wherein a displacement between the first and second positions moves said first and second cylindrical elements closer together and wherein a displacement between the second and third positions moves said first and second cylindrical elements further apart;

c. indicator means including i. a first indicator element coupled to said first cylindrical element and positioned within said first interior chamber;

ii. a second indicator element positioned within the second interior chamber and displaceable between a first position spaced apart from said first indicator element and a second position contacting said first indicator element, whereby said first indicator element changes visual state when it contacts said second indicator element;

d. means for biasing said first indicator element toward said second indicator element; and e. locking means for maintaining said first and second indicator elements in a locked, spaced apart configuration while said first and second cylindrical elements remain in the first position, for enabling relative movement to occur between said first and second indicator elements after said first and second cylindrical elements have been displaced from the first position into the second position, and for enabling said biasing means to displace said first and second indicator elements together to establish contact and to effect the change in visual state of said first indicator element upon displacement of said first and second cylindrical elements from the second position into the third position.

2. The tamper indicator of claim 1 wherein said second cylindrical element includes a longitudinal axis, a top and a wall and wherein said locking means includes a plurality of circumferentially spaced apart slots positioned in the wall of said second cylindrical element extending parallel to the longitudinal axis of said second cylindrical element and downward from the top along the wall of said element.

3. The tamper indicator of claim 2 wherein said slots extend downward to form a base and wherein said locking means further includes a notch extending laterally from the base of each of said slots.

4. The tamper indicator of claim 3 wherein said second indicator element is oriented perpendicular to the longitudinal axis of said second cylindrical element and wherein said locking means includes a plurality of circumferentially spaced apart spokes extending through said slots.

5. The tamper indicator of claim 4 wherein said spokes are displaced into and locked by said notches while said first and second cylindrical elements are maintained in the first position.

6. The tamper indicator of claim 5 wherein said first cylindrical element includes a wall and a longitudinal axis aligned with the longitudinal axis of said second cylindrical element and wherein said locking means includes means disposed in the wall of said first cylindrical element for laterally displacing said spokes out of said notches and into alignment with said slots as said first and second cylindrical elements are displaced from the first position into the second position.

7. The tamper indicator of claim 6 wherein said locking means enables said spokes to travel upward along said slots as said first and second cylindrical elements are displaced from the second position into the third position.

8. The tamper indicator of claim 7 wherein said first indicator means includes a first color which changes to a second color upon contact with said second indicator means.

9. The tamper indicator of claim 8 further including a cap for engaging a mouth of a container and wherein said first cylindrical element is coupled to said cap.

10. The tamper indicator of claim 9 wherein said second cylindrical element includes a base and a flange extending outward from said base to contact the mouth of said container.

11. The tamper indicator of claim 10 wherein installation of said cap onto the mouth of said container displaces said first and second cylindrical elements from the first position into the second position.

12. The tamper indicator of claim 11 wherein removal of said cap from the mouth of said container displaces said first and second cylindrical elements from the second position into the third position.

13. The tamper indicator of claim 12 wherein said cap includes viewing means for enabling changes in the visual state of said first indicator element to be seen by an individual inspecting said container.

14. The tamper indicator of claim 13 wherein said second indicator element includes a reservoir containing a colored liquid and wherein said first indicator element includes means for receiving the colored liquid.

15. The tamper indicator of claim 14 wherein said colored liquid receiving means comprises an absorbent material.

16. The tamper indicator of claim 15 wherein the colored liquid includes ink.

17. The tamper indicator of claim 6 wherein said spoke displacement means includes an inclined plane formed in the wall of said first cylindrical element.

18. The tamper indicator of claim 17 further including alignment means for preventing relative rotation between said first and second cylindrical elements as said elements are moved between the first and second positions or between the second and third positions.

19. The tamper indicator of claim 18 wherein said alignment means includes a plurality of inwardly extending lugs disposed in the wall of said first cylindrical element and a plurality of vertically oriented slots disposed in the wall of said second cylindrical element in alignment with said lugs in said first cylindrical element.

* * * * *